US007914171B2

(12) United States Patent
Fabbri et al.

(10) Patent No.: US 7,914,171 B2
(45) Date of Patent: Mar. 29, 2011

(54) AIR-HANDLING LUMINAIRE

(75) Inventors: William C. Fabbri, Barnstead, NH (US); Roy B. Crane, Wilmington, MA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 320 days.

(21) Appl. No.: 12/265,794

(22) Filed: Nov. 6, 2008

(65) Prior Publication Data

US 2010/0108288 A1 May 6, 2010

(51) Int. Cl.
*F21V 29/00* (2006.01)

(52) U.S. Cl. ..... 362/218; 362/148; 362/149; 362/294

(58) Field of Classification Search ..... 362/218, 362/147, 148, 149, 150, 223, 294, 373
See application file for complete search history.

(56) References Cited

U.S. PATENT DOCUMENTS

| | | | | |
|---|---|---|---|---|
| 3,692,977 | A * | 9/1972 | Duhamel et al. | 392/347 |
| 7,320,536 | B2 * | 1/2008 | Petrakis et al. | 362/364 |
| 2008/0019126 | A1 * | 1/2008 | Straton et al. | 362/218 |

* cited by examiner

*Primary Examiner* — Laura Tso

(57) ABSTRACT

An air-handling luminaire comprises a recessed troffer housing having a first pair of opposed walls and a second pair of opposed walls, the housing having a light output opening and a lens extending across the light output opening, at least one of the walls of the first pair of opposed walls and the second pair of opposed walls being substantially vertical and having at least one flow through opening for fluid communication from a volume beneath the recessed troffer housing to a plenum above the recessed troffer housing and, a rail extending from near a lower edge of the recessed troffer housing upwardly within the recessed troffer housing and adjacent the at least one flow through and concealing the at least one flow through opening.

16 Claims, 8 Drawing Sheets

AIR-HANDLING LUMINAIRE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention pertains to an air-handling luminaire. More particularly, the present invention pertains to an air-handling luminaire having hidden air flow through apertures.

2. Description of the Related Art

Air-handling luminaries are known to function as air registers in buildings wherein the space between floors may be utilized as an airflow plenum, in whole or in part, in combination with the HVAC system.

It is also known in the prior art to remove heat developed by the lighting fixture in order to remove the exhaust air from the illuminated room or use exhaust heat to warm a room on a floor above the subject lighting fixture. Additionally, removal of luminaire heat also helps to increase the efficiency of the light by allowing operation within a preselected temperature range to maximize the efficiency. In these types of arrangements, inverted T-grid or inverted slotted grid members are typically utilized to form a dropped ceiling wherein a plurality of acoustic insulating tiles are positioned in the openings of the grid. Some of the openings define positions wherein light fixtures such as fluorescent recessed luminaries are positioned. These luminaires are in fluid communication with the plenum through the air registers in the luminaire structure.

However, in these various types of luminaries, the air return slots in the luminaire are typically visible to a user standing in the room being illuminated. The slots or apertures may appear as dark holes in an otherwise smooth surface, which is undesirable. For example, the slots may be positioned in lower horizontal surfaces of the fixture and therefore easily seen by a viewer. It is desirable to conceal the air slots to improve the appearance of the luminaire to the person standing in the room being illuminated while inhibiting any degradation of the air flow through the luminaire and into the ceiling plenum.

SUMMARY OF THE INVENTION

An air-handling luminaire comprises a recessed troffer housing having a first pair of opposed walls and a second pair of opposed walls, the housing having a light output opening and a lens extending across the light output opening, at least one of the walls of the first pair of opposed walls and the second pair of opposed walls having at least one flow through opening for fluid communication from a volume beneath the recessed troffer housing to a plenum above the recessed troffer housing and, a rail extending from near a lower edge of the recessed troffer housing upwardly within the recessed troffer housing and adjacent the at least one flow through and concealing the at least one flow through opening. The air-handling luminaire wherein the at least one flow through opening being disposed in a vertical surface of the recessed troffer housing. The air-handling luminaire further comprising lens holders extending from one of the first and second pair of opposed walls. The air-handling luminaire wherein the lens is supported by the lens holders. The air-handling luminaire further comprising a lamp holder positioned above the lens. The air-handling luminaire further comprising feet extending from lower edges of the recessed troffer housing. The air handling luminaire further comprising a slot.

An air-handling luminaire comprises a troffer housing having a lower edge defining a lower light output opening, the troffer housing having a first pair of substantially vertical opposed walls and a second pair of opposed walls, a lens extending between at least one of the first pair and the second pair of opposed walls, at least one flow through passage extending through at least one wall of the first pair of substantially vertical opposed walls and the second pair of opposed walls in said troffer housing, a rail extending from adjacent the lower edge of the troffer housing upwardly adjacent the at least one flow through aperture defining a slot between the rail and the first pair of substantially vertical opposed walls so that the at least one flow through passage is concealed when viewed from beneath the troffer housing, the lens disposed above the at least one flow through passage. The air-handling luminaire further comprising feet disposed about a lowermost edge of the troffer housing. The air-handling luminaire further comprising lens holders supporting said lens, said lens holders extending from at least one pair of said opposed walls. The air-handling luminaire wherein the rail is integrally formed with the troffer housing. The air-handling luminaire further comprising a spacer disposed on the rail adjacent the housing preventing the rail from closing the flow through passage. The air-handling luminaire wherein the rail extending from the lower edge upwardly at an angle. The air-handling luminaire further comprising a connector plate connected to the housing and the rail. The air-handling luminaire wherein the rail has first and second opposed rails.

An air-handling luminaire having air passages hidden from view comprises a troffer housing for positioning in an air plenum, the housing having first and second sidewalls and first and second end caps, the housing having an opening at a lower end thereof for light output and fluid communication between a plenum at least partially above the housing and a space beneath the air-handling luminaire, at least one air passage in each of the first and second sidewalls, a rail extending upwardly from a lower area of the troffer housing and inhibiting viewing of the at least one air passage, a slot between an upper edge of the rail and a lens positioned within the housing allowing air flow through the slot to the at least one air passage, a lens disposed over the opening and allowing fluid communication between the slot and the plenum.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
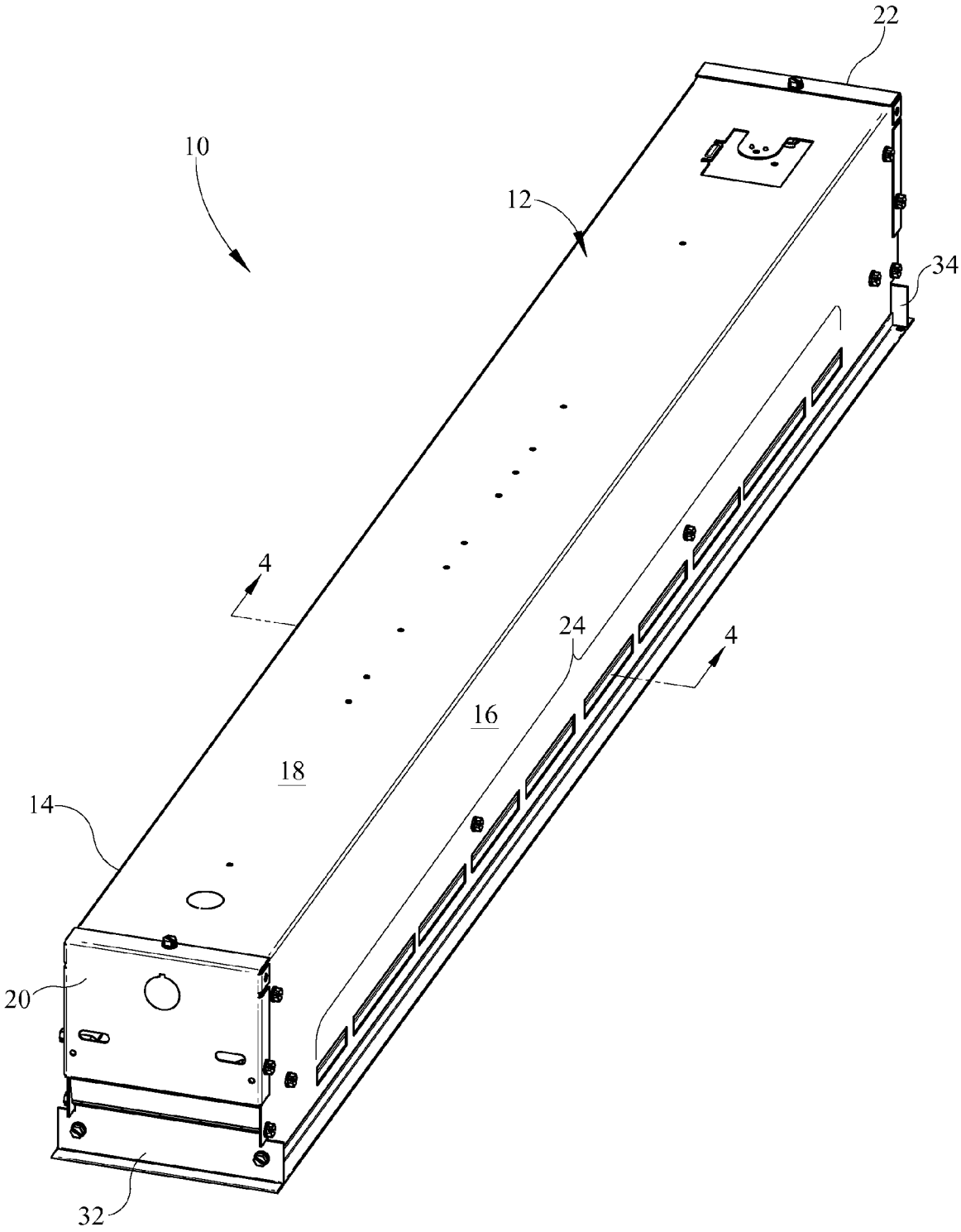
FIG. 1 is a perspective view of an air-handling luminaire.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now in detail to the drawings, wherein like numerals indicate like elements throughout the several views, there are shown in FIGS. 1-8 various aspects of an air-handling luminaire. The air-handling luminaire utilizes flow through apertures hidden from view from beneath the air-handling luminaire to provide an aesthetically pleasing appearance without inhibiting air flow.

Referring now to FIG. 1, a perspective view of an air-handling luminaire 10 is depicted. The luminaire 10 comprises a housing 12 defined by first and second sidewalls 14, 16 and first and second end caps 20, 22. In each of the sidewalls 14, 16 at least one ventilation passage or aperture 24 is positioned along the length of the sidewalls 14, 16. When the air-handling luminaire 10 is positioned within a suspended or dropped ceiling, the passages 24 allow air flow through the first and second sidewalls 14, 16 from beneath the luminaire 10 into a plenum which is defined above the lower most edge of the luminaire 10.

Figure 2:
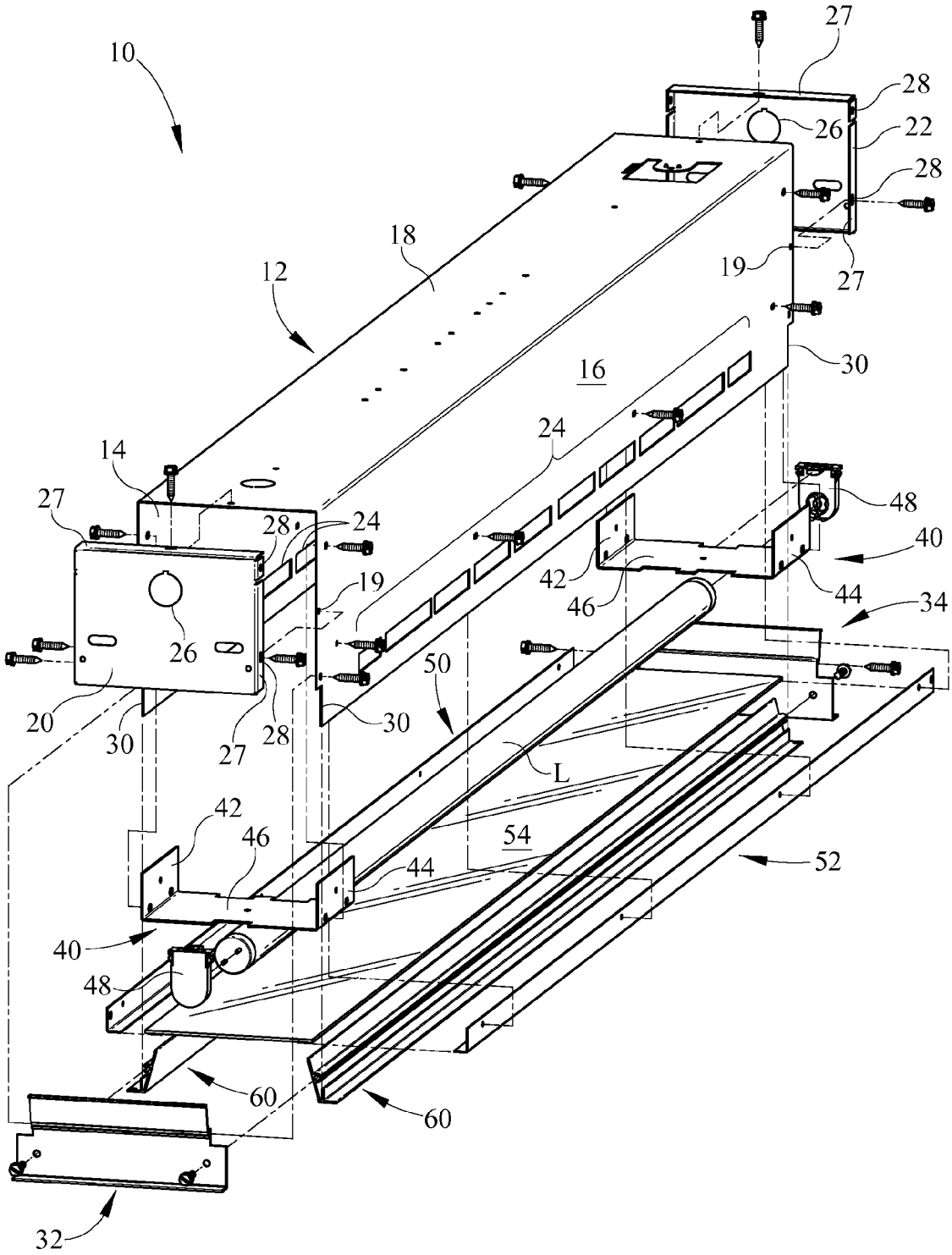
FIG. 2 depicts an exploded perspective view of the air-handling luminaire of FIG. 1.

Referring now to FIG. 2, an exploded perspective view of the air-handling luminaire 10 is depicted. The housing 12 is substantially U-shaped in cross-section and extends in a third, longitudinal dimension. The housing 12 is defined by the first sidewall 14, the second sidewall 16 and an interposed top wall 18 defining the inverted U-shape. The housing 12 may be formed of various materials such as aluminum, polycarbonates or other lightweight rigid materials which may be foldable from a flat piece to the substantially U-shaped design shown in FIG. 2. Alternatively, the material may be formable by molding or other known manufacturing procedures. Near ends of the first and second sidewalls 14, 16 is at least one fastening aperture 19. The exemplary embodiment utilizes multiple apertures 19.

As previously described, the housing 12 comprises end caps 20, 22 which are connected to the housing 12 by fasteners through the at least one aperture 19. The housing end caps 20, 22 are formed separately and fastened through the apertures 19, previously described. Each of the end caps 20, 22 comprises a tab 27 extending about at least one edge. According to the exemplary embodiment, the tabs 27 extend from three of the four edges. The tabs 27 include apertures 28 for alignment with the housing apertures 19 to provide connecting alignment between the housing 12 and end caps 20, 22. However such design is merely illustrative as the end caps 20, 22 may alternatively be integrally formed with the housing 12 if desired. The end caps 20, 22 each further comprise at least one knockout which is utilized to connect adjacent air-handling luminaires 10 with conduit and wiring. The housing top wall 18 may also comprise a knockout for ease of electrical connection of adjacent luminaires 10.

At ends of the sidewalls 14, 16 near lower portions of the vertical edges are notches 30. Received within the notches 30 are housing end plates 32, 34 which are positioned beneath the end caps 20, 22 and closed the remaining portion of the housing 12 beneath the end caps 20, 22. According to an alternative embodiment, the end caps 20,22 and end plates 32,34 could be integrally formed.

Referring still to FIG. 2, the exploded view depicts lamp holder arms 40. The arms 40 are substantially U-shaped and provide at least two functions. First, the lamp holder arms 40 provide lateral stability for the housing 12 along the planer direction of top wall 18, which does not include a lower wall between the first and second side walls 14, 16. Additionally, the arms 40 provide a seat for connecting lamp holders 42 to which a lamp tube L may be connected. The lamp holder arm 40 comprises first and second vertical portions 42, 44 and a horizontal connecting portion 46 extending between portions 42, 44. The vertical portions 42, 44 are positioned along the inside surfaces of side walls 14, 16 respectively. A fastener F may be utilized to attach the lamp holder arms 40 to the side walls 14, 16. Various types of fasteners may be used and the screw type fasteners depicted should not be considered limiting. For example, as an alternative, the lamp holder arm 40 may be integrally formed with the housing 12 or may be tack welded or joined by alternate fastening means. Connected to each holder arm 40 is a lamp holder 48. The lamp holder 48 of the exemplary embodiment is a bi-pin tube lamp which is common with fluorescent tubes however alternative lamp types may be used.

Beneath the lamping structures are lens holders 50, 52. Each of the lens holders of the exemplary embodiment are substantially L-shaped having a vertical leg portion and a horizontal foot portion. The vertical portion of each lens holder 50, 52 is positioned against the inner surface of the sidewalls 14, 16 and may be fastened, tack welded or integrally formed therewith. The horizontal foot portion provides a seat for a lens 54 wherein the lens may be positioned. The lens may be formed of glass, polycarbonate or other translucent material. Additionally, the lens 54 may be clear or may be diffusive of light passing there through. The lens 54 has a horizontal dimension which is greater than the distance between the horizontal lip portions of the lens holders 50, 52 so that the lens 54 may be seated there between. The lens 54 is seated in a position which is vertically disposed above the apertures 24 so that air flow through the luminaire 24 is not impeded.

Figure 3:
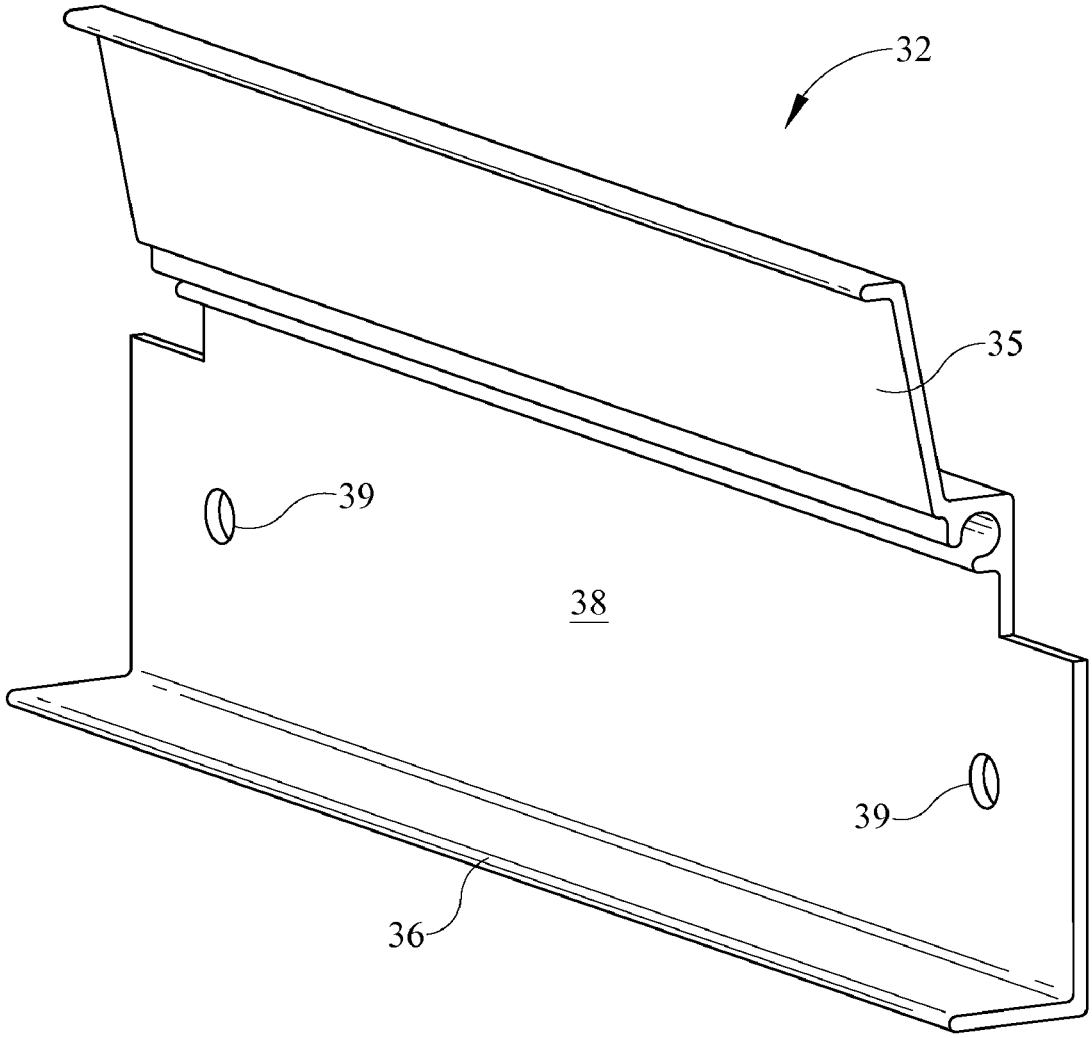
FIG. 3 depicts a perspective view of an end plate used with the air-handling luminaire of FIG. 1.

Referring now to FIG. 3, the end plate 32 is shown in a perspective view. Each end plate 32, 34 is positioned beneath an end cap 20, 22 respectively to control air into the luminaire 10. In other words, air is pulled into the luminaire 10 from beneath the ceiling level. The end plates 32, 34 and the end caps 20, 22 define walls of the housing 12 extending between the sidewalls 14, 16. The end plate 32 has a lower footing 36 which may be seated on a T-grid member wherein the air-handling luminaire 10 is positioned. Extending upwardly from the footing 36 is a plate member 38 having first and second apertures 39 which connects to opposed rails 60. Extending upwardly from the member 38 is a diagonally positioned flap that extends to the lower edge of the end caps 20, 22. At a junction between the member 38 and flap 35 is a screw channel 37. The channel 37 receives a fastener extending through the housing 12 and into the end plate 32 at two ends to hold the plate in position. Fasteners also extend through apertures 39 to hold the end plate 32 in a perpendicular direction to channel 37. The end plate 32 closes the lower opening portion of the housing 12 beneath the end caps 20, 22 so that the air flow is substantially limited and must pass through the ventilation passages 24 when moving from a room or volume beneath the luminaire 10 upwardly through the luminaire 10 into a plenum above a ceiling level.

Figure 4:
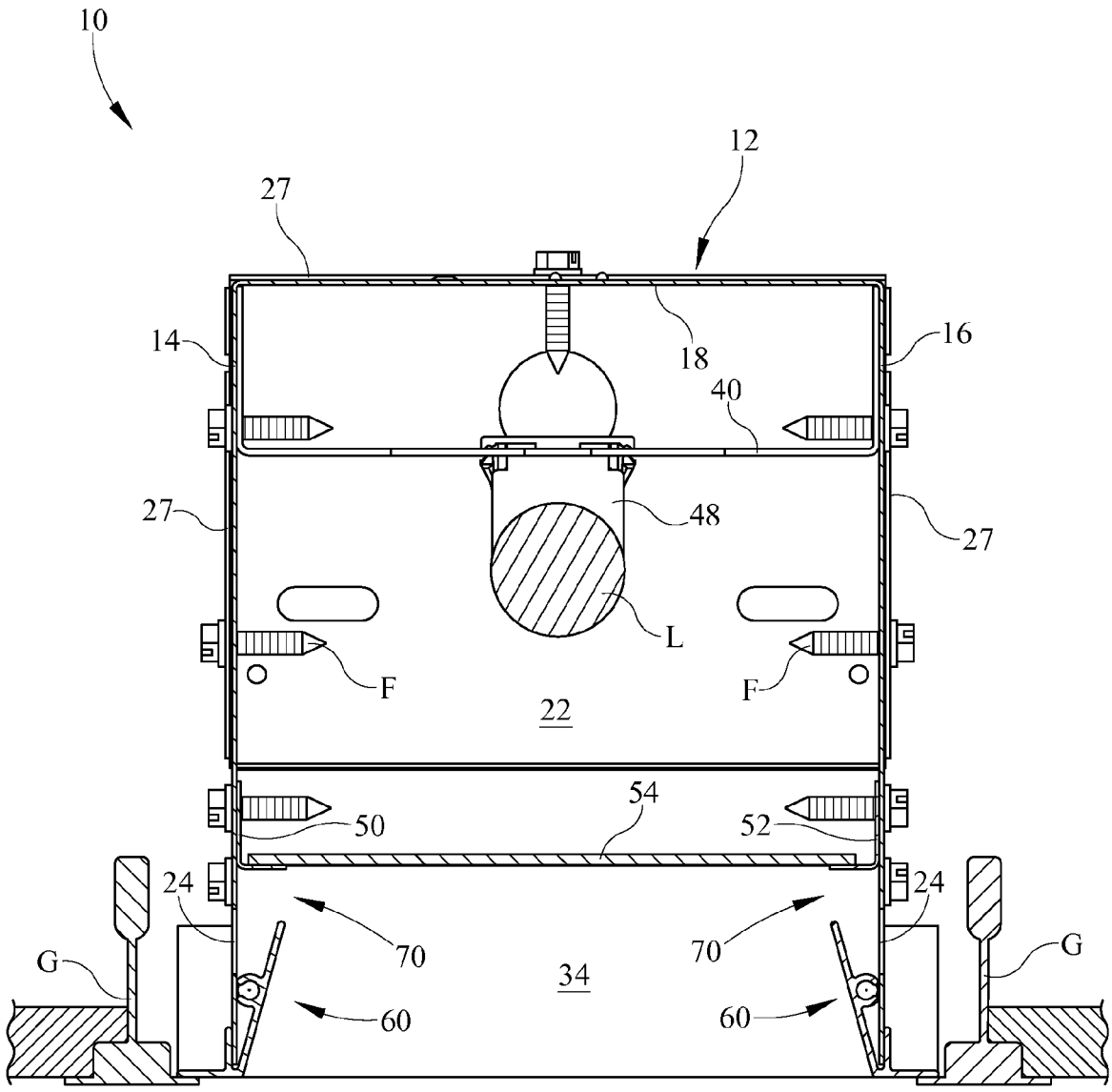
FIG. 4 depicts a sectional view of the air-handling luminaire of FIG. 1 along line 4-4.

Referring now to FIG. 4, a sectional view of the air-handling luminaire 10 is depicted. The end plate 22 is shown positioned at an end of the housing 12 and is positioned over the sidewalls 14, 16 and top wall 18. The lamp holder arm 40 is also depicted sandwiching the sidewalls 14, 16 between the arm 40 and tabs 27 of the end plate 22. Beneath the lens holders 50, 52 and the lens 54 are the side rails 60 which conceal the flow through air passages 24 from viewing when standing beneath the air-handling luminaire 10. Accordingly, contrary to prior art devices, the flow through air passages 24 (FIGS. 1, 2) are not seen when standing beneath the air-handling luminaire 10 and may be positioned in the vertical sidewall portions 14, 16 of housing 12.

Figure 5:
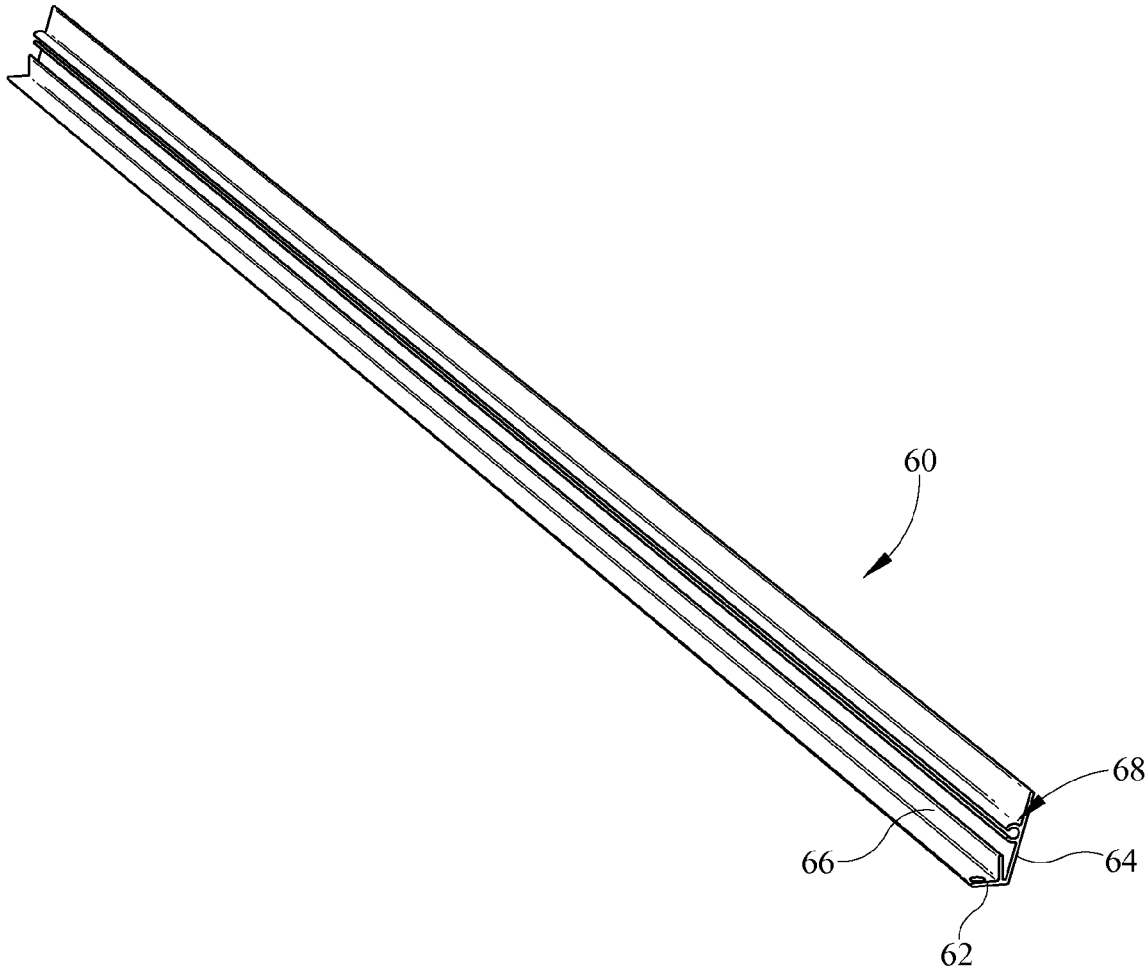
FIG. 5 depicts a perspective view of a rail member of the air-handling luminaire of FIG. 1.
Figure 6:
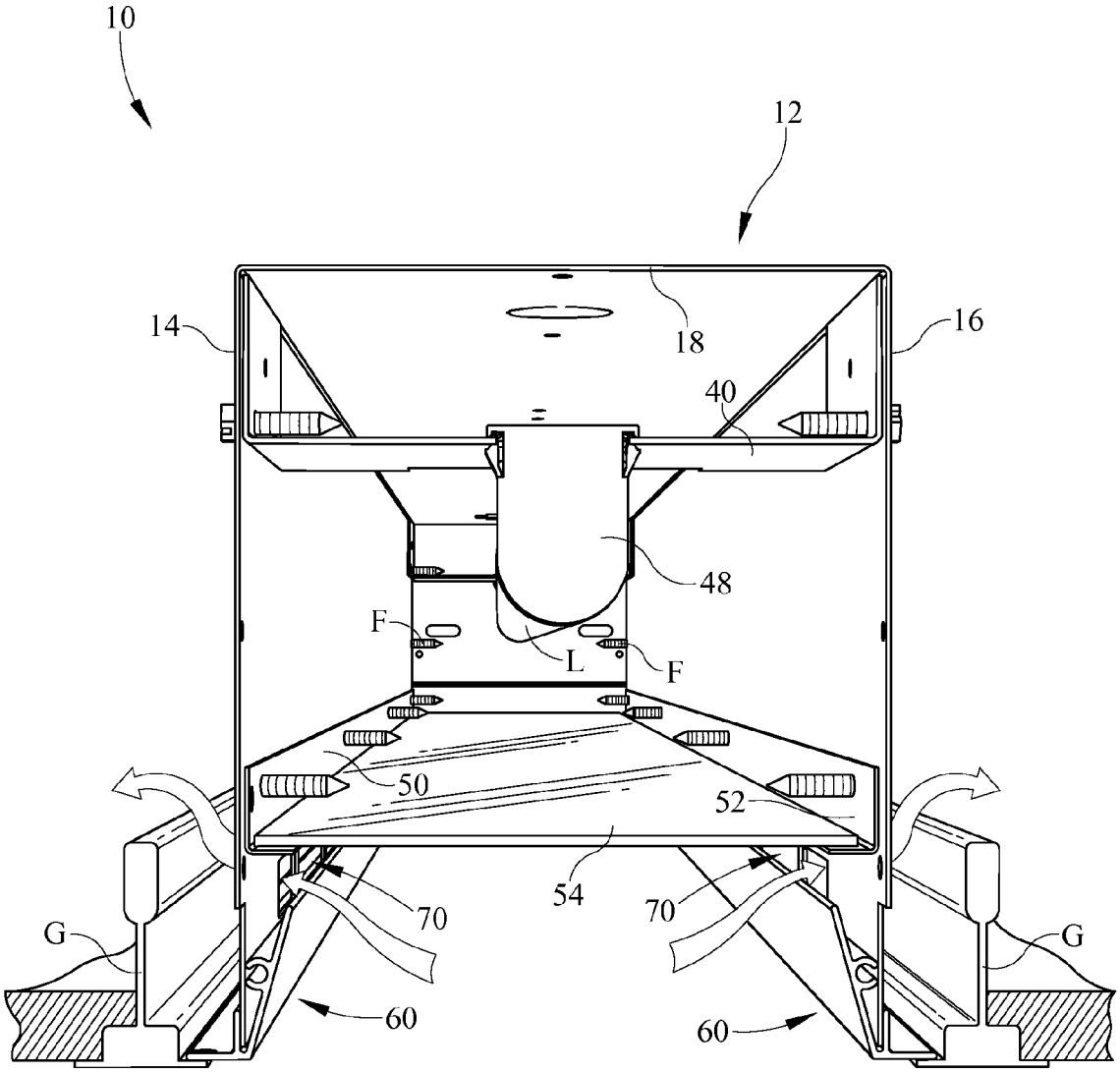
FIG. 6 depicts an end perspective view of the air-handling luminaire of FIG. 1 and further depicts the ventilation path through the luminaire.

Referring now to FIG. 5, a perspective view of side rail 60 is depicted. The side rail 60 comprises a lower foot portion 62 which functions to seat the air-handling luminaire on a T-grid member G (FIGS. 4, 6). Extending upwardly from the foot portion 62 is a wall 64 which extends at an angle upwardly from the foot 62. A short vertical wall 66 extends upwardly from the foot 62 and defines a gap between the wall 64 and short wall 66. Between the long wall 64 and short wall 66, the lower edge of the side walls 14, 16 may be seated as depicted in FIG. 4. The long wall 64 further comprises a fastening channel 68 which receives a fastener extending through endplates 32, 34. The fastening channel 68 also acts as a spacer between the flow through passages 24 and the wall 64, so that air flow may continuously move through the sidewalls 14, 16 (FIG. 1) and so that the passages or apertures 24 do not become blocked by the wall 64.

Referring now to FIG. 6, the air-handling luminaire 10 is shown in a perspective view so that the air passages 24 may be seen adjacent the side rails 60 and positioned on the inverted T-grid members G. Arrows are shown indicating air flow from the room beneath the luminaire 10 through the passages 24 and into the plenum above the ceiling area. The lens 54 inhibits air flow from b-passing the passages 24, instead forcing air upwardly through the passages 24.

Figure 7:
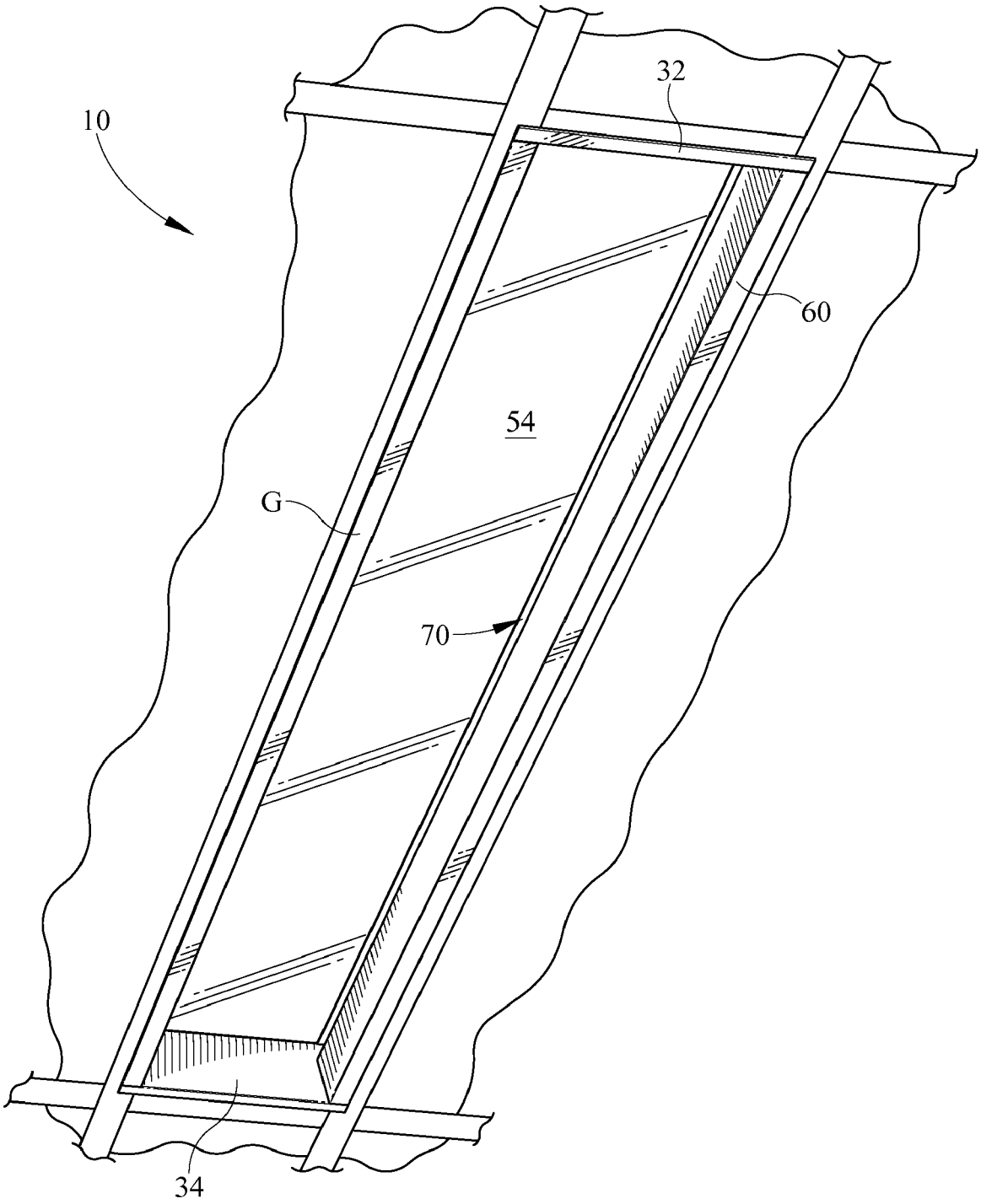
FIG. 7 depicts a first lower perspective view of the luminaire with the flow through apertures hidden from view; and, FIG. 8 depicts a second lower perspective view of the luminaire with the flow through apertures hidden from view.

Referring now to FIG. 7, a perspective view is depicted of the air-handling luminaire from below the ceiling level. When the air-handling luminaire 10 is viewed from below, the side rails 60 are visible extending between the endplates 32, 34. Above the side rails 60 and the endplates 32, 34 is the lens 54. Between the side rails 60 and the lens 54 are slots 70 through which airflow passes around the side rail 60 and to the airflow passages 24. Accordingly, when viewed from below, a user sees the illumination from the lens and the endplates 32, 34 and the side rails 60. The user also a sees the slot 70 defined between the lens 54 and the side rail 60. However, the user does not see the passages 24 into the plenum level which is typically aesthetically unpleasing.

Figure 8:
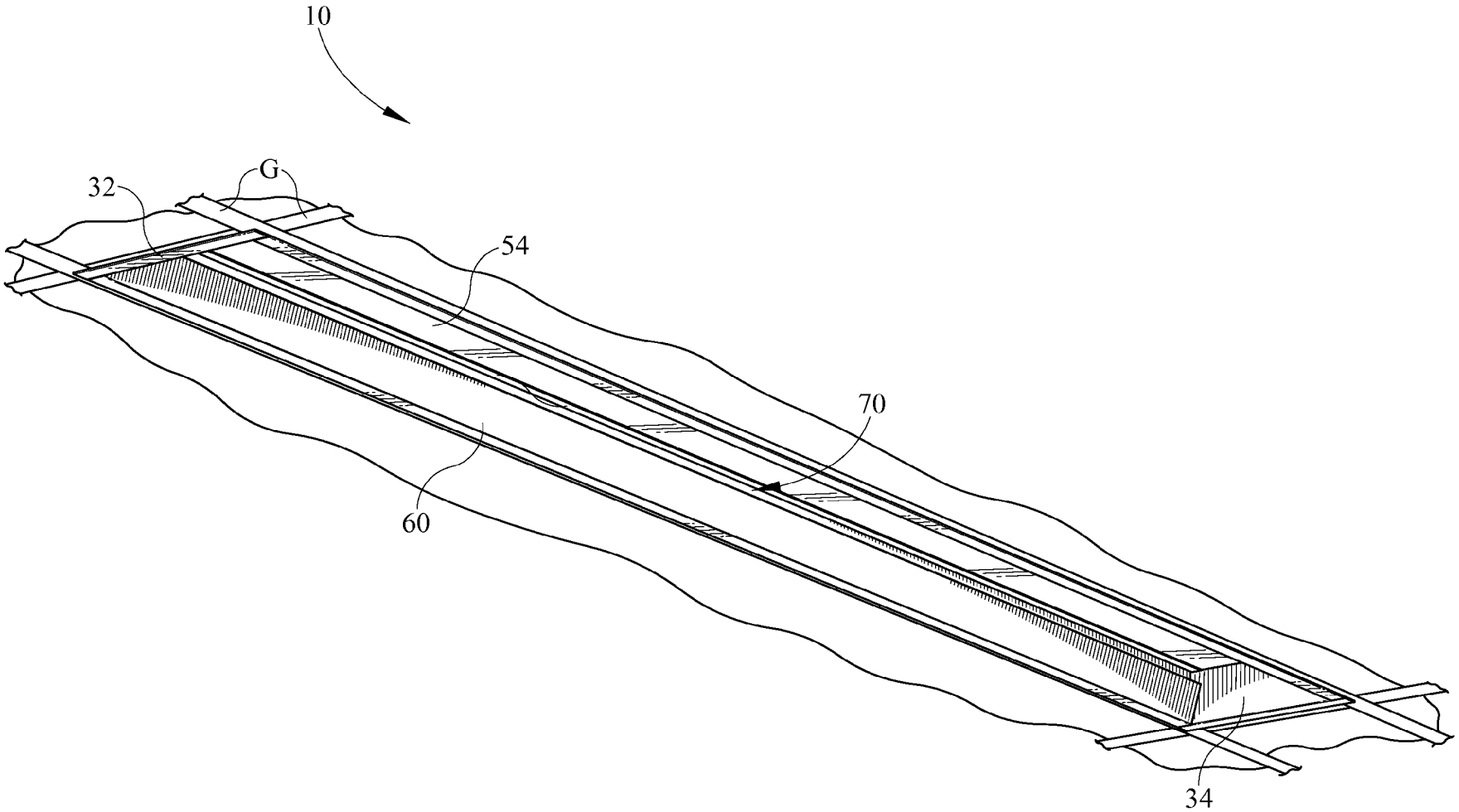

Referring now to FIG. 8, the air-handling luminaire 10 is again shown from below. The angle of the view as measured from the ceiling surface is less than that of FIG. 7. This allows for a better view of the slot 70. As depicted, the endplate 34 is depicted and extending between the endplate 34 and the opposite end of the luminaire 10 one of the side rails 60 is visible. The lens 54 is shown above and the slot 70 is also depicted between the side rail 60 and the lens 54. From this angle, air passages 24 are also not visible. Thus, the air-handling luminaire 10, when viewed from directly below or from an angle, hides the air passages 24 through which air passes to the plenum above the ceiling.

The foregoing description of structures and methods has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An air-handling luminaire, comprising:

a recessed troffer housing having a first pair of opposed walls and a second pair of opposed walls;

said housing having a light output opening and a lens extending between at least one of said first pair of opposed walls and said second pair of opposed walls;

at least one of said walls of said first pair of opposed walls and said second pair of opposed walls being substantially vertical and having at least one flow through opening for fluid communication from a volume beneath said recessed troffer housing to a plenum above said recessed troffer housing; and, a rail extending from near a lower edge of said recessed troffer housing upwardly within said recessed troffer housing and adjacent said at least one flow through opening and concealing said at least one flow through opening.

2. The air-handling luminaire of claim 1, said first pair of opposed walls and said second pair of opposed walls being vertical.

3. The air-handling luminaire of claim 1 further comprising lens holders extending from one of said first and second pair of opposed walls.

4. The air-handling luminaire of claim 3 said lens supported by said lens holders.

5. The air-handling luminaire of claim 4 further comprising a lamp holder positioned above said lens.

6. The air-handling luminaire of claim 1 further comprising feet extending from lower edges of said recessed troffer housing.

7. The air handling luminaire of claim 1, further comprising a slot.

8. An air-handling luminaire, comprising:

a troffer housing having a lower edge defining a lower light output opening;

said troffer housing having a first pair of substantially vertical opposed walls and a second pair of opposed walls;

a lens extending between at least one of said first pair and said second pair of opposed walls;

at least one flow through passage extending through at least one wall of said first pair of substantially vertical opposed walls and said second pair of opposed walls in said troffer housing;

a rail extending from adjacent said lower edge of said troffer housing upwardly adjacent said at least one flow through aperture defining a slot between said rail and said at least one wall of said first pair of substantially vertical opposed walls so that said at least one flow through passage is concealed when viewed from beneath said troffer housing;

said lens disposed above said at least one flow through passage.

9. The air-handling luminaire of claim 8 further comprising feet disposed about a lowermost edge of said troffer housing.

10. The air-handling luminaire of claim 8 further comprising lens holders supporting said lens, said lens holders extending from at least one pair of said opposed walls.

11. The air-handling luminaire of claim 8 wherein said rail is integrally formed with said troffer housing.

12. The air-handling luminaire of claim 8 further comprising a spacer disposed on said rail adjacent said housing preventing said rail from closing said flow through passage.

13. The air-handling luminaire of claim 8, said rail extending from said lower edge upwardly at an angle.

14. The air-handling luminaire of claim 8 further comprising a connector plate connected to said housing and said rail.

15. The air-handling luminaire of claim 8, said rail being first and second opposed rails.

16. An air-handling luminaire having air passages hidden from view, comprising:

a troffer housing for positioning in an air plenum, said housing having first and second sidewalls and first and second end caps;

said housing having an opening at a lower end thereof for light output and fluid communication between a plenum at least partially above said housing and a space beneath said air-handling luminaire;

at least one air passage in each of said first and second sidewalls;

a rail extending upwardly from a lower area of said troffer housing and inhibiting viewing of said at least one air passage;

a slot between an upper edge of said rail and a lens positioned within said housing allowing air flow through said slot to said at least one air passage;

said lens disposed over said opening and allowing fluid communication between said slot and said plenum.

* * * * *